US006877959B2

(12) United States Patent
McWhirter

(10) Patent No.: US 6,877,959 B2
(45) Date of Patent: Apr. 12, 2005

(54) SURFACE AERATION IMPELLERS

(75) Inventor: John R. McWhirter, Boalsburg, PA (US)

(73) Assignee: Mixing & Mass Transfer Technologies, LLC, State College, PA (US)

( * ) Notice: Subject to any disclaimer, the term of this patent is extended or adjusted under 35 U.S.C. 154(b) by 17 days.

(21) Appl. No.: 10/453,057

(22) Filed: Jun. 3, 2003

(65) Prior Publication Data

US 2004/0247443 A1 Dec. 9, 2004

(51) Int. Cl.[7] ..... F04D 29/28
(52) U.S. Cl. ..... 416/228; 416/235; 366/265
(58) Field of Search ..... 416/223 R, 228, 416/235, 243; 366/263, 265

(56) References Cited

U.S. PATENT DOCUMENTS 3,290,016 A 12/1966 Lennon et al.
3,341,450 A 9/1967 Ciabattari et al.
3,679,323 A * 7/1972 Buck ..... 416/183
4,066,383 A 1/1978 Lakin
4,334,826 A 6/1982 Connolly et al.
4,548,765 A 10/1985 Hultholm et al.
4,882,098 A 11/1989 Weetman
5,152,934 A 10/1992 Lally et al.
5,988,604 A 11/1999 McWhirter
6,715,912 B2 * 4/2004 McWhirter et al. ..... 366/265

FOREIGN PATENT DOCUMENTS

JP 60223930 A * 11/1985 ..... F24F/7/007

* cited by examiner

*Primary Examiner*—Ninh H. Nguyen
(74) *Attorney, Agent, or Firm*—McQuaide, Blasko, Schwartz, Fleming & Faulkner, Inc.

(57) ABSTRACT

The invention is an improved surface aeration impeller for use in a liquid filled tank which particularly increases the surface turbulence and the entrainment of gas into the liquid surface. The impeller is an axial flow impeller and may be either a pitched blade turbine (PBT) or have airfoil shaped blades. In either case, the impeller has a portion which extends radially along an edge thereof which projects above the surface of the liquid being mixed in a vertical direction. The blades of the impeller are modified to include a top horizontal plate to lower the spray height of the liquid and an optional endcap, both of which can enhance and increase the standard aeration efficiency. Preferably, the impeller is rotated in an up-pumping direction and propels the liquid being aerated in a radially upward and outward direction. A sufficient upward surge of liquid is produced so that the liquid is observed to splash back onto the surface a plurality of times in the course of operation of the impeller. Such multiple splashing action enhances the contact between the air and the liquid itself to improve the oxygen transfer efficiency of the aeration impeller.

19 Claims, 4 Drawing Sheets

SURFACE AERATION IMPELLERS

FIELD OF THE INVENTION

The present invention relates to surface aeration impellers which are disposed near the surface of a body of liquid in a tank and propel the liquid being aerated in an upward and radially outward direction, thereby efficiently contacting the liquid with the gas for the purpose of exchanging mass between the gas and the liquid phase.

BACKGROUND OF THE INVENTION

The present invention relates to improved surface aeration impellers which are used for the surface aeration of liquids in a tank when disposed at the surface of the liquid in the tank, and which have hydraulic performance and adaptations resulting in higher efficiency of aeration. This aeration is particularly important in a number of industrial processes, such as in the aeration of sewage and other wastewater streams. These processes generally involve biochemical oxidation using aerobic microbes. It is typically desirable to transfer oxygen from the surrounding gas or air into the liquid to allow the microbes to work most efficiently.

The two most common techniques for the transfer of oxygen from air or other oxygen containing gas are gas sparging and surface aeration. In a gas sparging procedure, a gas (e.g. air or oxygen) is bubbled through the liquid in a manner that increases the amount of dissolved oxygen in the liquid. In contrast, surface aeration uses an impeller located close to the surface of the liquid to agitate or spray the liquid into the gas. The liquid spray subsequently re-impinges on the liquid surface which also entrains gas into the liquid surface.

Mechanical surface aeration was first introduced more than forty years ago. This technique made use of a mechanical agitator operating near the liquid surface to throw or spray liquid into the air and to induce entrainment of air into the liquid surface, without the use of a compressor and diffusers. Since that time, a fairly large number of different designs for surface aeration impellers have been introduced, both for the purpose of increasing the oxygen-transfer efficiency and also, secondarily, if possible, to improve the bulk liquid mixing and solids suspension. The problem of solids suspension, however, has an obvious limitation because of the remoteness of the surface aeration impeller from the tank bottom where the biomass solids tend to settle if the bulk liquid in the tank is not adequately mixed.

The standard measure of aeration efficiency is the number of pounds of oxygen transferred into the liquid at 20° C. and zero dissolved oxygen level per hour per horsepower used to operate the aeration system. This measure is known as the Standard Aeration Efficiency (SAE). The SAE for current state of the art surface aeration devices ranges from about 2.0 to about 3.3 pounds of oxygen per hour per horsepower in commercial aerator sizes. In smaller sizes, the efficiency values can be somewhat higher. Since wastewater treatment plants are pure cost centers (i.e. they do not sell a product) and since electric power is one of the main operating costs in such a plant, the oxygen-transfer efficiency performance of such aerators is extremely important, especially in larger plants. This need has led to a number of attempts at producing surface aeration impeller designs with greater oxygen transfer efficiency.

Many of the limitations associated with prior art surface aerator impeller designs result from an insufficient understanding of the fundamental mass transfer mechanisms and fluid dynamics of surface aeration. The current state-of-the-art oxygen mass transfer analysis for surface aerators is essentially limited to the simple, idealized model employed in the ASCE Standard for the Measurement of Oxygen Transfer in Clean Water. This oversimplified and limited model has been used for decades to characterize the oxygen mass transfer performance of surface aerators. A more realistic and rigorous mass transfer model has been developed by McWhirter et al. in "Oxygen Mass Transfer Fundamentals of Surface Aerators", Ind. Eng. Chem. Res. 34, 2644-2654, 1995. This mechanistic model provides a more physically realistic description of the actual oxygen transfer mechanisms of surface aerators and separates the oxygen mass transfer process into two distinct zones: a liquid spray mass transfer zone and a surface reaeration mass transfer zone.

These two distinctly different mass transfer mechanisms or zones are created by all generic types of mechanical surface aerators. The liquid spray mass transfer zone (46 in FIG. 4) is created in the immediate gas space surrounding the periphery of the surface aeration impeller where the liquid is discharged into the surrounding gas at high velocity. The surface reaeration mass transfer zone (48 in FIG. 4) exists primarily outside the spray umbrella and in the bulk liquid near the surface in the area that is circumferential to the periphery of the liquid spray mass transfer zone. The two zones are schematically diagramed in FIG. 4. The liquid spray mass transfer zone can be reasonably characterized and modeled as a single-stage gas-liquid contacting zone wherein the liquid is dispersed into a virtually infinite, continuous gas phase of constant gas composition above the liquid surface. In contrast, the mechanism in the surface reaeration mass transfer zone is predominately characterized by oxygen transfer to a highly turbulent, high velocity liquid phase containing entrained gas from the gas phase above the liquid surface. As the liquid spray zone impinges on the liquid surface of the tank, substantial gas bubble entrainment into the surface is accomplished and a "white-water" effect is produced at the periphery of the liquid spray impingement on the surface of the tank liquid. The surface reaeration mass transfer zone also includes the oxygen transfer to the highly turbulent liquid surface beneath the spray umbrella and thus includes all oxygen transfer to the surface liquid due to bubble entrainment and contact of the highly turbulent liquid surface with the gas above the liquid surface.

In contrast to generally perceived prior opinion regarding the primary oxygen transfer mechanism of surface aerators, the present inventors have quantitatively shown that about two-thirds of the oxygen transfer of surface aerators occurs in the surface reaeration mass transfer zone and only about one-third in the liquid spray mass transfer zone. This suggests that impeller designs that enhance oxygen transfer in the surface reaeration zone (e.g. by increasing surface turbulence and increasing volume flow rates) may have a greater overall effect on the total oxygen transfer of the system than impeller designs that focus primarily on increasing oxygen transfer in the spray zone (e.g. by improving spray characteristics by increasing the height and distance traveled by the sprayed liquid). Thus, a greater understanding of the oxygen mass transfer mechanisms in surface aerators has allowed the present inventors to independently analyze the oxygen transfer process within these two distinctively separate mass transfer zones leading to the improved surface aerator impeller designs as disclosed in this application. These new designs pump more liquid per unit of horsepower input through the liquid spray mass transfer zone and into the surface reaeration zone and thereby maximize the total oxygen mass transfer efficiency of the overall surface aeration system.

Surface aeration impellers which have been used in the past are generally either radial flow impellers or pitched blade turbines (PBT). The blades are flat rectangular plates which are pitched, usually at an angle of 45° to the axis of rotation of the impeller. The 45° pitch is also to the surface of the liquid in the tank when the impeller is not causing flow of the liquid. This is termed the static level of the liquid. Such impellers are located close to the static liquid surface and a small (10 to 20 percent) portion of the width of the blade can project up through the surface. Usually the direction of rotation is such that the leading edge of the blade is above the surface, while the trailing edge is below the surface. In other words, the impeller is pitched forwardly in the direction of rotation of the impeller about its axis of rotation. With such rotation, the impeller is normally down-pumping. The liquid is pushed out in front of the angled blade and discharged radially across the surface of the tank with some of the liquid being sprayed (usually in large drops and not as an atomized spray) into the atmospheric air from the outer upper surfaces of the blade.

Several state of the art surface aeration impellers currently exist, including those shown in U.S. Pat. Nos. 4,066,383 to Lakin; 4,334,826 to Connolly et al; 4,882,098 to Weetman; 5,152,934 to Lally; and 5,988,604 to McWhirter.

Thikotter discloses a surface aeration impeller to be used in an activated sludge process. The aerator comprises a flat, circular impeller disc having a plurality of blades depending from the undersurface of the disc. The blades are generally flat, positioned radially and have a height that decreases from its inner edge to its outer edge. This design primarily focuses on spraying the liquid and does not provide much up-pumping action or mixing of the tank liquid content resulting in relatively low efficiency of the system. In contrast, Lakin and Connolly disclose forms of surface aeration impellers having primarily vertically curved blades. Most seem to have multiple blades on a disc-shaped mounting member.

Both Lally and Weetman teach systems using axial flow impellers which can disperse the gas more efficiently to reduce flooding. McWhirter '604 discloses a surface aeration impeller that is an axial flow impeller that may have either pitched blade turbine or airfoil shaped blades. The blades are not mounted to the underside of a disc, and although the upper section of the blades are not strictly radial, at least at one point the lower section of the blades is radial. However, this impeller still leaves room for improved liquid pumping and oxygen transfer efficiency.

Although these above-described surface aeration impellers have accomplished their purposes, problems remain regarding excessive splashing and misting, insufficient liquid pumping, and overflow of liquid over the surface aerator blades during operation. Thus, there continues to be a need for improved designs that further increase the efficiency of the aeration process.

One problem in particular with some prior art surface aeration impellers is that at the liquid submergence levels of the blades for normal operation as surface aerators, a significant quantity of liquid overflows the upper or leading edge of the blades and falls back into the impeller itself without being pumped and sprayed beyond the outer periphery of the impeller blades. The amount of liquid which is moved per unit of energy input (the hydraulic efficiency) of the impeller is adversely affected due to the flow of liquid over the top of the blade characterizing the normal PBT turbine surface aeration impeller operation. In addition, the overflow of liquid over the leading edge of the blades is believed to overload or flood the impeller with liquid which creates a hydraulic condition detracting from its hydraulic pumping capacity and oxygen transfer efficiency.

A surface aeration impeller provided by the present invention has a structure and mode of operation which counteracts the foregoing hydraulic and oxygen transfer deficiencies.

Therefore, it is the principal object and feature of this invention to provide improved surface aeration impellers which are especially adapted for use as surface aerators which operate more efficiently than conventional surface aeration impellers, and particularly by better controlling the flow of liquid and spray.

It is a further object of the invention to provide improved axial flow aeration impellers which may be operated in an up-pumping direction causing flow, which creates a hydraulic surge ahead of and radially outward from the impeller at a plurality of positions radially outward in the tank, at each of which increased turbulence occurs, such as splashing, which further enhances the oxygen transfer efficiency of the system.

It is a still further object of the present invention to provide improved PBT aeration impellers.

It is a still further object of the present invention to provide improved surface aeration impellers which may have camber and may be of air foil shape.

SUMMARY OF THE INVENTION

The invention is an improved surface aeration impeller for use in a liquid filled tank which efficiently sprays liquid and improves gas entrainment and oxygen transfer into the liquid surface. The impeller is an axial flow impeller and may be either a pitched blade turbine (PBT) or have airfoil shaped blades. In either case, the impeller has a portion which extends radially along an edge thereof which projects above the surface of the liquid being mixed in a vertical direction. The blades of the impeller are modified to include a top horizontal portion of the blade which tends to lower the spray of the liquid and an optional endcap, both of which simultaneously enhance and increase the standard aeration efficiency. Preferably, the impeller is rotated in an up-pumping direction and propels the liquid being aerated in a radially upward and outward direction. A sufficient upward surge of liquid is produced so that the liquid is observed to splash back onto the surface a plurality of times in the course of operation of the impeller. Such multiple splashing action enhances the contact between the air and the liquid itself to improve the efficiency of aeration.

DETAILED DESCRIPTION OF THE INVENTION

Figure 1:
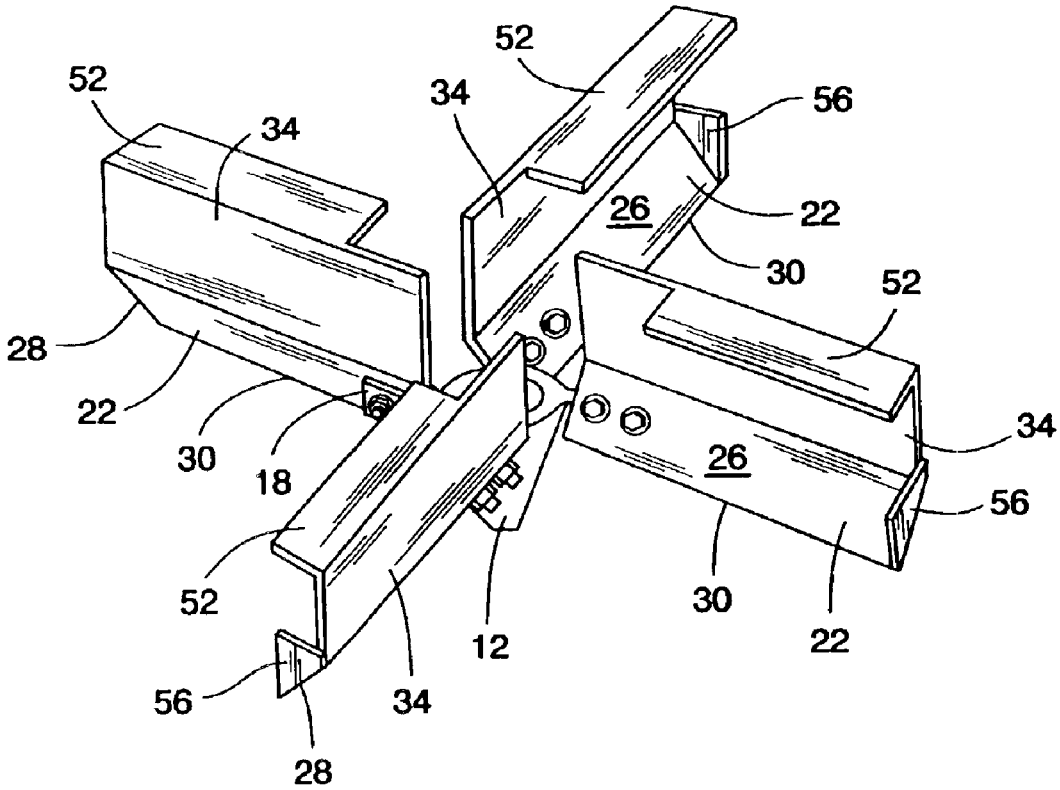
FIG. 1 is a perspective view of a surface aeration impeller in accordance with the invention.

Referring to FIGS. 1–4 there is shown a shaft 10 having a hub 12 attached thereto by set screws and a key. The hub therefore rotates with the shaft. The hub has four arms 18 which are tilted at an angle (45°) with respect to the axis of rotation 20. Four blades 22 are attached to the arms 18 by groups of bolts and nuts. The number of bolts and nuts in the group depends upon the dimensions of the impeller. Other attachment means, such as weldments may be used for attaching the blades 22 to the hub 12.

The blades have lower portions 26 which are preferably rectangular plates having an outer edge 28 at the radially outward ends of the blades between the generally radially extending edge 30 and the generally radially extending joint between the lower portion 26 and the upper portion 34. The blade outer edges 28 are at 45° with respect to the shaft axis 20 in this example. However, this angle can be in the range of about 30° to 60° preferably about 40° to 50° and most preferably is about 45°. Each of the blade portions also has a vertically upward extending portion 34 which is a rectangular plate.

Figure 2:
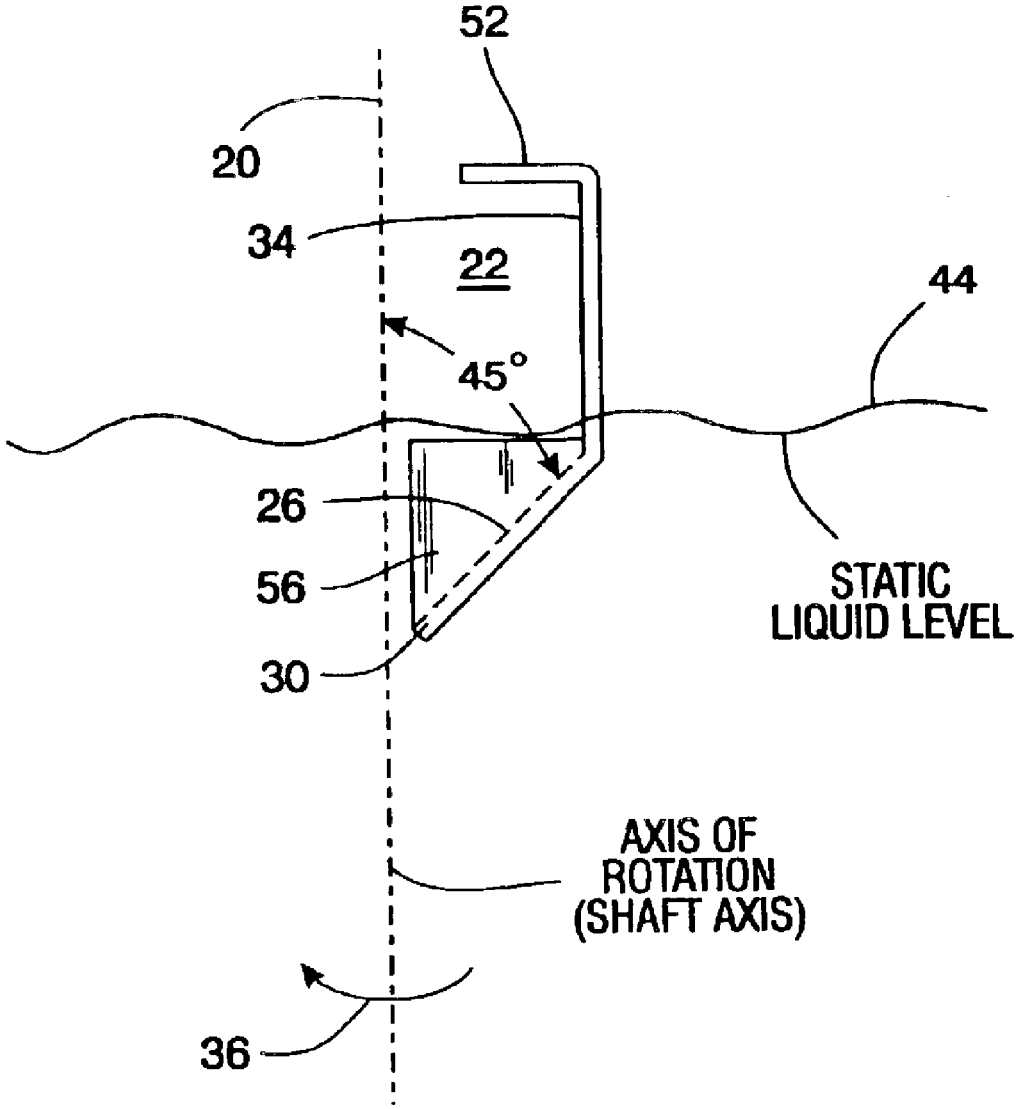
FIG. 2 is a front elevation towards the tip of one of the blades of the impeller shown in FIG. 1 showing an endcap on the outer lower blade edge and a top horizontal plate on the upper edge, which is labeled and dimensioned in accordance with dimensions useful in the embodiment shown in FIG. 4 (that is, an open tank surface aeration system where the tank diameter is typically four to eight times the diameter of the impeller).
Figure 3:
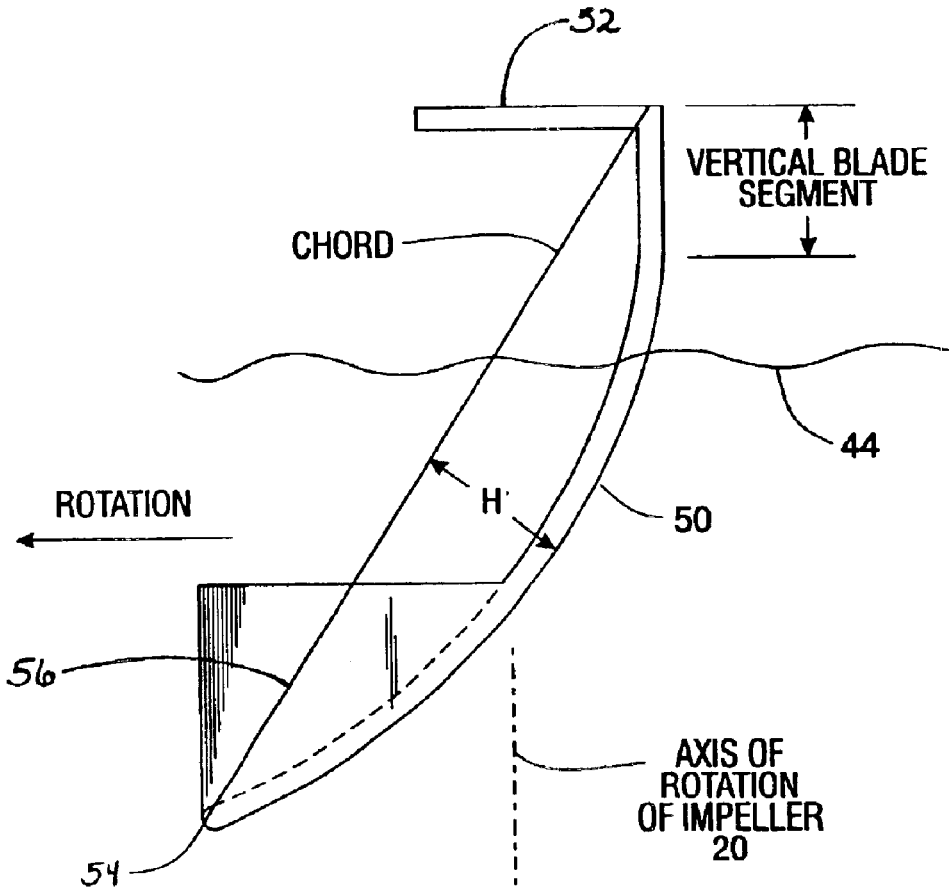
FIG. 3 is an end view in elevation, similar to FIG. 2, illustrating an air foil (sometimes called hydrofoil) surface aeration impeller shape and showing the chord between the leading and trailing edges thereof and the height from the mid-line (halfway of the thickness of the impeller) to the chord, which as a percentage of the chord, is the camber of the impeller.
Figure 4:
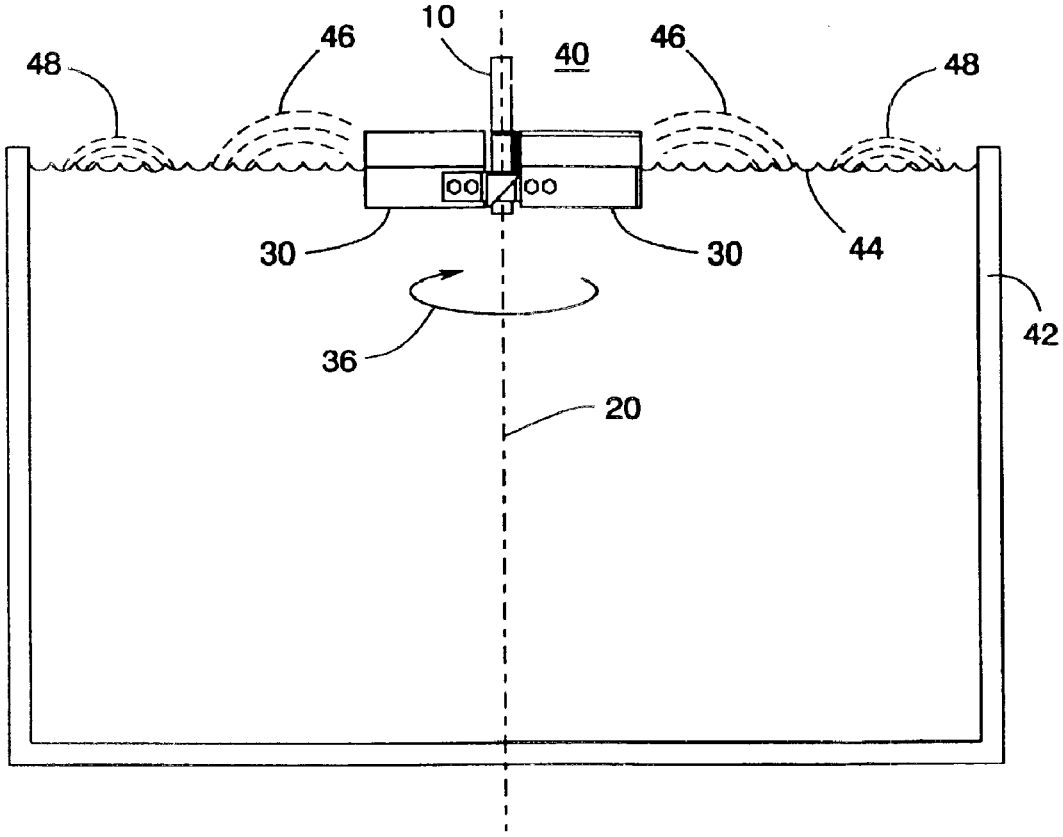
FIG. 4 is a view of an aeration system including the impeller shown in FIGS. 1, 2 and 3 in operation in an open aeration tank.

The blades have an upper horizontal plate 52 as shown in FIGS. 1, 2 and 3. This upper horizontal plate is a generally rectangular plate positioned essentially perpendicular to the vertically upward extending portion 34 and extending along the top edge of the vertically upward extending portion 34. The top horizontal plate 52 of the blade may extend along the entire length to the inner edge of the vertical portion 34, but is generally one-half to two-thirds of the length. The width of the top horizontal plate 52 is about the same width as that of the lower portion. In one embodiment, this width is about 8 to 10 inches. In a preferred embodiment of the invention, the top horizontal plate is about 8 inches wide with a length of two thirds of the vertical portion 34. The addition of the top horizontal plate lowers the height of liquid spray in the free space above the liquid surface 44 as shown in FIG. 4 and further increases the oxygen transfer aeration efficiency of the impeller.

For ease of manufacturing and mounting, the inventors have found that a generally or substantially rectangular shape for all of these sections works well, though other shapes are certainly useable. In a preferred embodiment of the invention, each blade is made from a single rectangular piece of metal that has been creased in two positions. The first crease of this embodiment occurs approximately two-thirds to three-fourths of the way down the length of the entire rectangular piece of metal. This crease provides for the downward and outwardly (in the direction of rotation) extending lower portion of the blade 26 and the vertical upwardly extending portion 34. The width of the lower portion of blade 26 is about one-half the width of the top portion. A second crease can provide for the top horizontal plate of the blade. This second crease occurs approximately one-quarter to one-third of the way down the length of the entire rectangular piece of metal. Note that in the embodiment where the top horizontal plate does not run the entire length of the blade, the piece of starting sheet metal to be creased to make the entire blade would not be a rectangle but rather a rectangle with one corner cut out.

The number of blades on the surface aeration impeller of the present invention is generally in the range of about 4 to 12. The optimal number of blades will depend on the specific application, however, smaller diameter impellers will generally have fewer blades and larger diameter impellers typically will have more blades. In preferred embodiments the number of blades is about 4 to 8 and in an even more preferred embodiment there are exactly 6 blades. The design of the hub 12 will be modified with more than 4 blades.

The generally vertical portions 34 act as the primary liquid spraying surfaces. They act to direct the liquid to flow upwardly and radially outward instead of overflowing the top edges of the lower portion of the blade. The liquid leaving the tips 28 discharges as a high-velocity liquid spray, which may be in the form of bodies of liquids or drops which splash back onto the liquid surface in the tank and which have been found to increase the oxygen transfer efficiency of the impeller of FIGS. 1–3. The pumping rate, and the circulation rate and the oxygen transfer capacity of the aeration system, including the impeller of FIGS. 1–3, are increased over surface aeration systems using the conventional or standard 45° PBT aeration impellers.

The impeller may be rotated in a counterclockwise direction which is conventional for normal surface aeration PBT impellers. However, the preferred direction of rotation for the impeller shown in FIG. 1 is clockwise which will provide for an up-pumping effect. The mass transfer efficiency and hydraulic pumping capacity is further significantly enhanced compared with conventional aerator designs. Operating the present invention, as shown in FIG. 1, in the conventional direction would make the lower edge 30 the trailing edge resulting in the impeller then being down-pumping. Up-pumping operation is presently preferred and if additional circulation is required, a secondary impeller may be located on an extension of the shaft which is located further downward from the surface in the tank.

The blades of the invention have an optional segment known as an endcap 56 located at the outside radial edge of the lower blade segment as shown on FIGS. 1, 2 and 3. The endcap 56 is a relatively flat geometric piece positioned essentially perpendicular to the vertical portion 34 and connects the outer or trailing edges of both the vertical portion 34 and the lower portion 22 but is primarily located on the outward edge 28 of the lower portion. While the exact shape of the endcap can vary widely, the critical feature of the endcap is that it prevents liquid from flowing or "sliding" off the outer edge of the blades below the vertical portion 34 and simultaneously enhances the uplifting or up-pumping capability of the impeller. The inventors have found that an endcap can significantly increase the power delivered and simultaneously increase the standard aeration efficiency as the examples below demonstrate.

The impeller, illustrated in FIGS. 1, 2 and 3, is shown in FIG. 4 at 40, located in the center of a tank 42 which may be a large circular or rectangular tank of several hundred thousand gallons capacity, up to a million gallons, typical of tanks used for wastewater treatment aeration. The diameter or width of the tank may be several to many times the diameter of the impeller, say four to eight times the diameter of the impeller in a typical installation. The shaft 10 of the impeller is driven by a conventional drive, including a motor and gear box (not shown). The surface 44 of the liquid is illustrated as being the static level in FIG. 4. However, during actual operation, the impeller is rotating in an up-pumping direction (which is the direction of arrow 36 for the impeller of FIG. 1). The lower edges 30 are the leading edges and the 45° pitched portions 26 are disposed so that the upper edges thereof, are slightly (suitably 10 to 20 percent of the width of the blades) above the surface 44 when at the static level, and the blades rotate in the up-pumping direction as illustrated by the arrow 36. Then a surge of liquid results, which raises the level 44 in front of the impeller blades. The liquid is smoothly pumped up and across the blades and radially across the vertically extending portions 34 thereof, and is efficiently discharged at the blade tips 28. The height of the vertical portions is also such that most of the liquid is discharged as the radial spray indicated at 46 at the tips of the blades. The spray drops back onto the surface of the liquid in the tank, splashing and further increasing the contact with the air, thereby improving the mass transfer and oxygenation of the liquid. It has also been found that there is an additional hydraulic jump or spray 48 further radially outward from the axis 20, perhaps one or two feet from the inner spray 46. This outer spray also splashes back towards the surface of the liquid in the tank 42, still further enhancing the aeration and mass transfer efficiency of the aeration system.

FIG. 2 illustrates an improved blade 22 having the 45° pitched portion 26 and the vertical portion 34, which may also be considered as providing a vertical fin on the portion 26, with the top horizontal plate 52. It will also be noted that the blade may be made in one piece rather than having the vertical portion 34 attached to the pitched portion 26. It is preferable that the leading, lower edge 30 be a knife edge or rounded, so as to reduce vortices at the leading edge as the blade rotates in the direction 36 and provides for up-pumping operation. The dimensions for the width of the blade portions 26 and 34, shown in FIG. 2, have been found especially suitable for surface aeration operation. A typical overall surface aerator diameter may be 5 to 8 feet.

The following table illustrates the improvement in mass transfer efficiency, in terms of the pounds of oxygen dissolved per horse power per hour at 20° C. and zero dissolved oxygen in the liquid (SAE). The first row in the table is data for a conventional, standard 45° PBT operated without using the top horizontal plate. The second row is for an aeration impeller illustrated in FIGS. 1 through 4, operated using the top horizontal plate. Both impellers were arranged centrally in an approximately 250,000 gallon tank.

TABLE

| IMPELLER | IMPELLER DRIVING POWER (HP) | SAE | SOTR |
|---|---|---|---|
| STD | 52.97 | 3.57 | 189.68 |
| FIGS. 1–4 | 75.68 | 4.09 | 310.48 |

Where SAE is the standard aeration efficiency in pounds of $O_2$ per HP-Hr. (Horsepower-Hour), and SOTR is the standard oxygen ($O_2$) transfer rate in pounds of oxygen per hour. Standard conditions are room temperature (20° C.) and one atmosphere pressure and zero dissolved oxygen in the liquid phase. Note that the table shows an increase in SAE of about 10%, but under extremely severe aeration conditions with low driving HP per 1000 gallons of liquid under aeration.

Referring to FIG. 3, there is shown an air foil impeller 50 provided by the invention and used as a surface aeration impeller. This impeller 50 is made of a plate and has camber which is the ratio of the maximum height (H) to the length of the chord. The chord is pitched at an angle with respect to the axis of rotation and the surface 44 of the liquid. The pitch may suitably be in the range of about 30° to 60°, preferably about 45°. The leading edge 54 of the impeller is rounded or knife-edged and the impeller has a vertical blade segment which extends a sufficient distance above the surface 44 so as to provide the enhanced pumping and hydraulic efficiency as well as enhanced aeration characteristics as discussed in connection with the improved PBT impeller illustrated in FIGS. 1 through 4.

From the foregoing description, it will be apparent that there has been provided an improved surface aeration system and aeration impellers especially suitable for use therein. Variations and modifications in the system and in the herein-described impellers, within the scope of the invention, will undoubtedly suggest themselves to those skilled in the art. Accordingly, the foregoing description should be taken as illustrative and not in a limiting sense.

What is claimed is:

1. A surface aeration impeller designed to rotate about an axis perpendicular to a static liquid surface, said impeller comprising a plurality of blades attached to a hub mountable on a shaft for rotation about said axis;

wherein said blades comprise an upper generally vertical portion, a lower inclined non-vertical portion which is pitched with respect to said axis, and a substantially horizontal top plate on the upper edge of said vertical portion and extending outward in the direction of rotation from the upper edge of said vertical portion.

2. The surface aeration impeller according to claim 1 wherein said upper and lower portions are generally rectangular shaped.

3. The surface aeration impeller according to claim 1 wherein said horizontal top plate is a generally rectangular plate perpendicular to the top edge of said upper vertical portion.

4. A surface aeration impeller according to claim 1 wherein said horizontal top plate is about the same width as the lower inclined portion.

5. The surface aeration impeller according to claim 4 wherein said horizontal top plate is about 8 to 10 inches wide.

6. A surface aeration impeller according to claim 1 wherein said horizontal top plate is about one-half to full length of the upper vertical portion.

7. The surface aeration impeller according to claim 6 wherein said horizontal top plate is about two thirds of the length of the upper vertical portion.

8. The surface aeration impeller according to claim 1 wherein said lower inclined non-vertical portion of the impeller is positioned at an acute angle to said axis.

9. The surface aeration impeller according to claim 8 wherein said angle is in the range of about 30° to 60°.

10. The surface aeration impeller according to claim 8 wherein said angle is about 45°.

11. The surface aeration impeller according to claim 1 wherein each of said blades is a curved member having an airfoil shape defining a chord and having camber, said blade being disposed so that said chord is at an acute angle to said axis, said member having first and second portions, at least a portion of said second portion, at least in part extending vertically above said liquid level.

12. The surface aeration impeller according to claim 11 wherein said chord angle varies from about 30° to 60°.

13. The surface aeration impeller according to claim 11 having from 4 to 12 blades.

14. The surface aeration impeller according to claim 13 having about 6 blades.

15. The surface aeration impeller according to claim 1 having from 4 to 12 blades.

16. The surface aeration impeller according to claim 15 having from 4 to 8 blades.

17. The surface aeration impeller according to claim 15 having about 6 blades.

18. The surface aeration impeller according to claim 1 wherein said blades additionally contain an endcap.

19. The surface aeration impeller according to claim 18 wherein said endcap is substantially perpendicular to the vertical upper portion and attaches the outer edges of said vertical upper portion and said lower inclined non-vertical portion.

* * * * *